US006092710A

United States Patent [19]

Kersten

[11] Patent Number: 6,092,710

[45] Date of Patent: Jul. 25, 2000

[54] EXPLOSIVE POWDER CHARGE OPERATED BOLT-SETTING TOOL

[75] Inventor: Olaf Kersten, Krefeld, Germany

[73] Assignee: Berner GmbH, Germany

[21] Appl. No.: 09/093,976

[22] Filed: Jun. 9, 1998

[51] Int. Cl.[7] ..... B25C 1/14

[52] U.S. Cl. ..... 227/10; 173/211

[58] Field of Search ..... 227/9, 10, 11, 227/147, 130; 173/210, 211

[56] References Cited

U.S. PATENT DOCUMENTS

| | | | |
|---|---|---|---|
| 2,877,750 | 3/1959 | Maier . | |
| 2,904,787 | 9/1959 | De Caro | 227/10 |
| 3,115,637 | 12/1963 | Elliot | 227/10 |
| 3,255,942 | 6/1966 | Bell et al. . | |
| 3,338,141 | 8/1967 | Ramsay | 227/10 |
| 3,744,240 | 7/1973 | Henning et al. . | |
| 3,815,475 | 6/1974 | Howard et al. . | |
| 4,134,527 | 1/1979 | Termet | 227/10 |
| 4,625,442 | 12/1986 | Hill et al. | 227/10 |
| 4,711,385 | 12/1987 | Jochum . | |
| 4,711,851 | 12/1987 | McNamara et al. . | |
| 4,753,151 | 6/1988 | Peterson . | |
| 4,824,003 | 4/1989 | Almeras et al. . | |
| 4,941,391 | 7/1990 | Ehmig et al. . | |
| 5,538,172 | 7/1996 | Jochum et al. . | |
| 5,617,925 | 4/1997 | Boothby et al. | 173/211 |
| 5,676,434 | 10/1997 | Ichikawa et al. . | |
| 5,797,534 | 8/1998 | Almeras et al. . | |

FOREIGN PATENT DOCUMENTS

| | | |
|---|---|---|
| 0346275 | 12/1989 | European Pat. Off. . |
| 1058950 | 6/1959 | Germany . |
| 1478814 | 2/1970 | Germany . |

*Primary Examiner*—Scott A. Smith
*Attorney, Agent, or Firm*—Douglas J. Christensen

[57] ABSTRACT

The invention relates to an explosive powder charge operated bolt-setting tool having a bolt guide (2) which has a through bore (4) for explosive powder charge actuable driving piston (5), a ball brake being provided for the driving piston (5), which brake is designed as a freewheel for the return of the driving piston (5) and comprises a recess (9), which is open radially towards the driving piston (5) and has two spring-loaded brake balls (12) each of which are accommodated therein, and which bear against the driving piston (5) and which can be moved, with maximum and minimum spring loading, between two axial stops (3, 16) along an oblique surface (15) which widens conically at an acute angle towards the driving piston (5). In this case, there is inserted into the recess (9), adjacent to the outside of each brake ball (12), an insert (14) provided with the oblique surface (15), the inserts (14) being acted upon in the axial direction by a respective spring (8), the springs (8) being supported on the outside by a retaining ring (6).

10 Claims, 3 Drawing Sheets

5.1
5.2
1
7
12
10
11
15
16
8
8
5
II
II
6
3
13
14
2
4
1.1
2.2
22

3
6
11
7
15
10
12
8
8
9
13
14
14
7

II 1
14
13
8
5.4
6
5.2
3
2
7
12
11
10
17
15.2
5
15
12
4
16
15.4
14
II

EXPLOSIVE POWDER CHARGE OPERATED BOLT-SETTING TOOL

BACKGROUND OF THE INVENTION

The invention relates to an explosive powder charge operated setting tool suitable for setting bolts.

European Patent No. 0,346,275 discloses a setting tool, the driving piston of which is braked, as it moves forward, by a ball brake which does not, however, adversely affect the return of the driving piston into its starting position. A recess which is open radially towards the driving piston is provided for this purpose, the axial extent of said recess, with respect to the piston axis, exceeding the diameter of the brake ball and being acted upon by a spring ring which acts radially towards the driving piston, and on its inner circumference has a supporting surface for the brake ball, which is inclined at an acute angle opening towards the driving-in direction, with the result that the brake ball tensions the spring ring as the driving piston moves forward and is intended to come to rest at that end of the recess which is on the driving-in side, but is not intended to reduce the speed of return of the driving piston. Because a spring ring of this type has to be cut open after having been hardened and tempered, in order to be able to act as a spring ring, it causes problems as the cutting-open procedure means that it does not spread in an easily controllable manner, particularly since it is not of uniform thickness. Even small differences in tolerance have the particular effect that braking forces act on the driving piston even when it is returning. This is disadvantageous, in particular in the case of a repeating bolt-setting tool, for reliably returning the driving piston into its starting position.

SUMMARY OF THE INVENTION

The invention relates to an explosive powder charge operated bolt-setting tool having a bolt guide which has a through bore for explosive powder charge actuable driving piston, a ball brake being provided for the driving piston, which brake is designed as a freewheel for the return of the driving piston and comprises a recess, which is open radially towards the driving piston and has two spring-loaded brake balls each of which are accommodated therein, and which bear against the driving piston and which can be moved, with maximum and minimum spring loading, between two axial stops along an oblique surface which widens conically at an acute angle towards the driving piston. In this case, there is inserted into the recess, adjacent to the outside of each brake ball, an insert provided with the oblique surface, the inserts being acted upon in the axial direction by a respective spring, the springs being supported on the outside by a retaining ring.

It is an object of the present invention to provide an explosive powder charge operated bolt-setting tool, in which freewheeling of the driving piston as it moves back is reliably achieved with a simple construction.

This and other objects and features of the invention will be understood upon consideration the following detailed description of the invention and the accompanied drawings.

DETAILED SPECIFICATION

Figure 1:
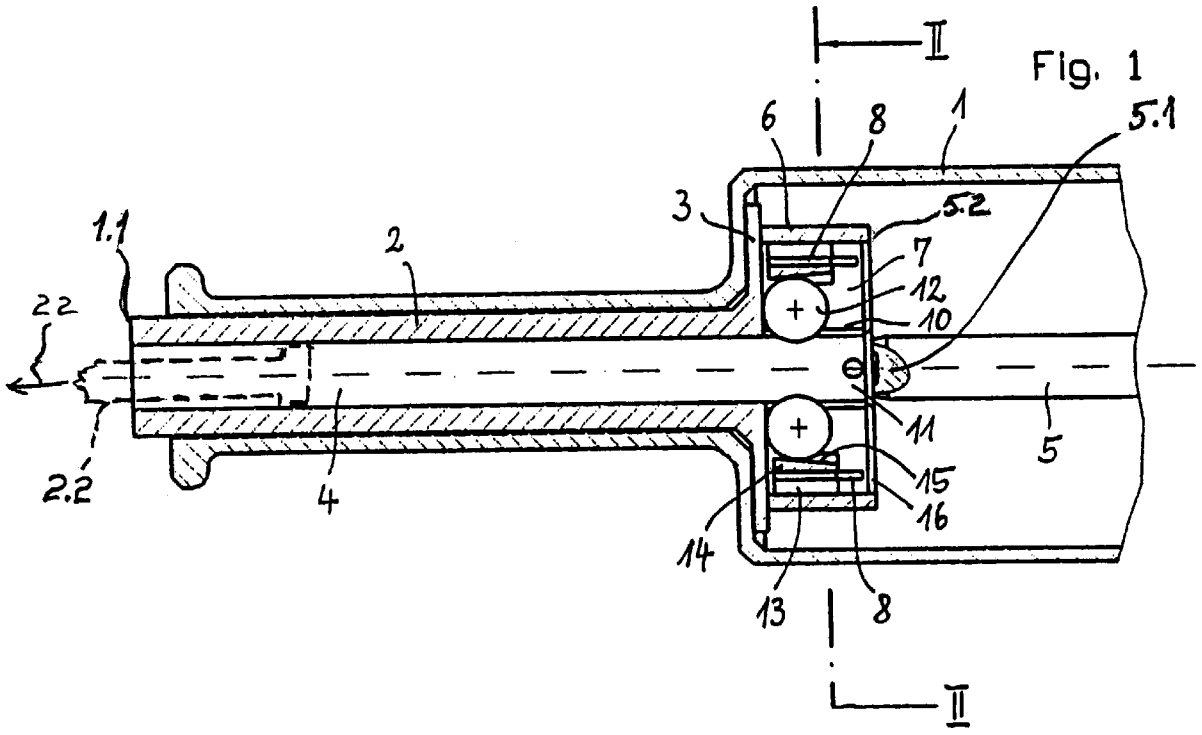
FIG. 1 is a detail in axial section of an explosive powder charge operated bolt-setting tool according to the invention.
Figure 2:
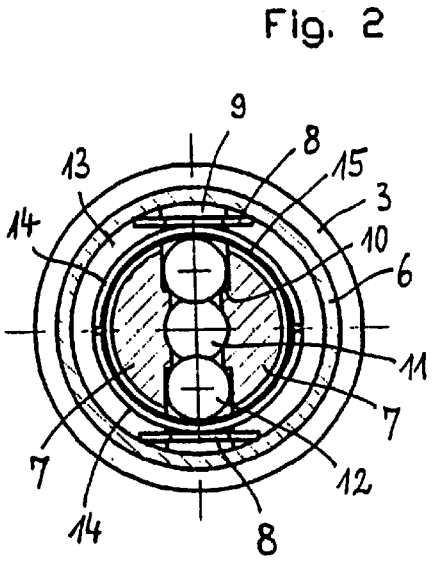
FIG. 2 is a sectional view along the line 11—11 of FIG. 1.

The explosive powder charge operated setting tool, of which a detail is shown, comprises a housing 1 which is provided on the mouth side with a bolt guide 2, in the form of a sleeve, for receiving bolts 2.2 to be fired. The bolt guide 2 is supported on that side which is remote from the mouth by a flange 3 within the housing 1.

The bolts, which are inserted into the through bore 4 of the bolt guide 2, are driven in a direction as indicated by the arrow 2.2 by means of a driving piston 5 with a piston head 5.1, which is accommodated by a piston guide (not shown). The bolt guide 2 can be connected to the piston guide.

Ball brake 5.2 has a ball brake support structure 5.4 comprising a retaining ring 6 fastened on the bolt guide 2 by means of a clamping pin, for example. The receiving ring 6 accommodates two semicircular extensions 7 of the bolt guide 2, which extensions support two springs 8 arranged between them and designed as leaf springs. A slot-shaped recess 9, which extends in the axial direction of the bolt guide 2, is located between the extensions 7. The recess 9 has a central, somewhat narrowed region, thereby forming shoulders 10 which serve to support two brake balls 12, held relative to a central through opening 11 for the piston 5 (which opening is aligned with the through bore 4), in the recess 9, in such a manner that the brake balls 12 can protrude into the region of the through opening 11.

The two extensions 7 are provided with a peripheral groove 13 adjacent to the flange 3. The groove 13 accommodates two half shells 14 which are arranged in the groove 13 offset by approximately 90° with respect to the two extensions 7 and can be moved radially. The half shells 14 are pretensioned radially inwards by means of the springs 8 and act upon the brake balls 12, with the result that the brake balls 12, which protrude into the region of the groove 13, and also protrude into the region of the through opening 11 when they are not in the loaded state.

The springs 8 are supported laterally in the retaining ring 6 in the region of the groove 13 and extend, with a central leg, in the axial direction into that region of the recess 9 which is remote from the mouth, between the extensions 7.

The half shells 14 extend on the inside to the driving piston 5, i.e. conically, at an acute angle, towards that side which is remote from the mouth, and in this manner form oblique surfaces 15 for the brake balls 12.

A covering disc 16 is arranged on that side of the retaining ring 6 which is remote from the mouth, which covering disc encloses the freewheel located in retaining ring 6 and has a central through opening 17 for the driving piston 5. The cover disc 16 serves as a stop for the brake balls 12 on that side which is remote from the mouth, while the flange 3 serves as a stop for the brake balls 11 on that side which faces the mouth.

Figure 3:
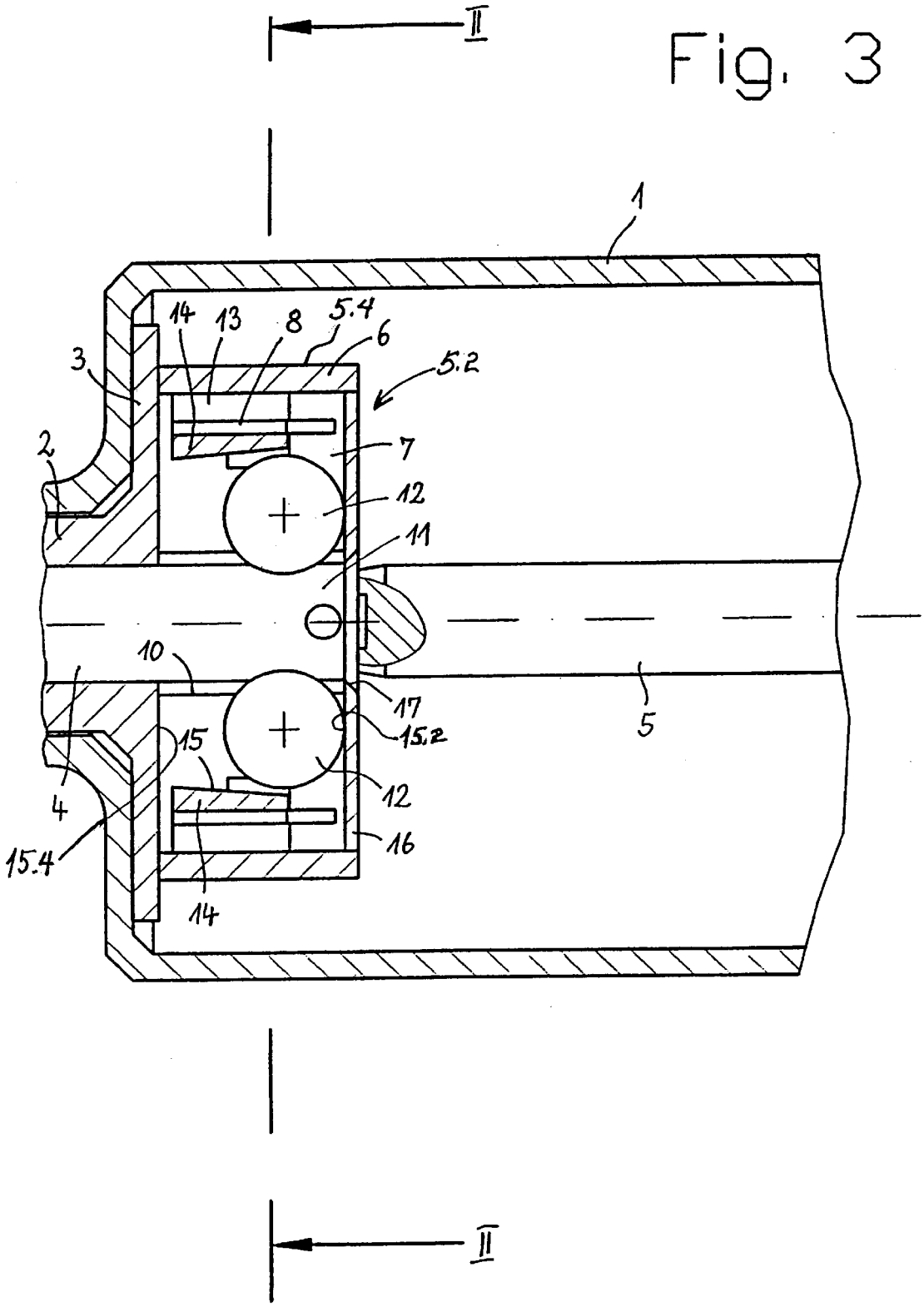
FIG. 3 is a sectional view from FIG. 1 on an enlarged scale.

The axial length of the recess 9 between the flange 3 and covering disc 16 is such that in the starting position the brake balls 12 are not in engagement with the oblique surfaces 15 of the half shells 14 in a manner such that the springs 8 would be tensioned. Rather, it is possible for the brake balls 12 to move freely in the axial direction due to corresponding play, if the driving piston 5 does not engage into the ball freewheel, cf FIG. 3. Only by the driving piston 5 engaging into the ball freewheel are the brake balls 12 pressed radially outwards, thereby achieving the braking action in the driving-in direction.

In this case, the driving piston 5 can end in its starting position in front of the brake balls 12 (as illustrated) or can protrude between the latter.

As the driving piston 5 moves forward, the brake balls 12 are taken along by it in the direction of the mouth and thereby move along the oblique surfaces 15, as a result of which the half shells 14 move radially away from one another. By this means, the springs 8 are correspondingly loaded and tensioned and the driving piston 5 braked as it moves forward. The brake balls are axially moveable between the stops 15.2 and 15.4.

This furthermore reliably ensures that the return of the driving piston 5 is not subject to braking, with the result that the automatic reaching of the starting position by the driving piston 5, in particular in the case of a repeating bolt-setting tool, is not adversely affected by braking force exerted upon it by brake balls 12.

Figure 4:
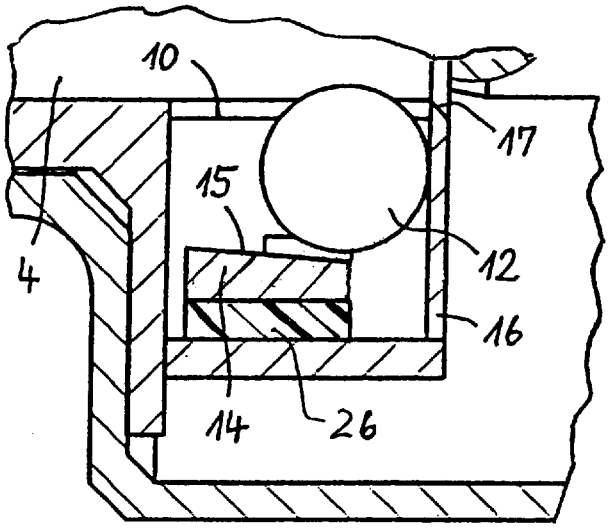
FIG. 4 is a sectional view similar to FIG. 3 illustrating different springs.
Figure 5:
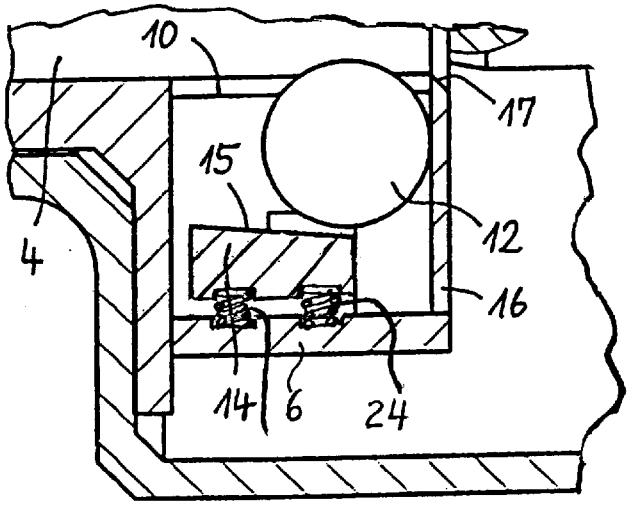
FIG. 5 is a sectional view similar to FIGS. 3 and 4 illustrating different springs.

Referring to FIGS. 4 and 5, instead of leaf springs 8 it is also possible to use helical springs 24 or elastomer inserts 26 which act on the half shells 14. The peripheral groove 13 can also be omitted and instead the recess 9 can be widened in its place in order to receive, on the radially outer side of the brake balls 12, a respective insert 14, in the form of a plate, having a corresponding oblique surface 15, which inserts are each spring-loaded by an elastomer insert 26 or a helical spring 24 supported in the retaining ring 6.

Spring steel is not required for the inserts 14 since they themselves are not spring-loaded, but only have to be arranged such that they can move radially and are in each case acted upon by their own spring 8, with the result that the corresponding tolerances can readily be adhered to during manufacture in order, in this respect, to ensure trouble-free operation of the bolt-setting tool.

The extensions 7, which extend the bolt guide 2, can be of one-piece design, as shown, of one-piece design with the bolt guide 2 or else separate therefrom. In the latter case, they can be fastened on the bolt guide 2 directly or indirectly via the retaining ring 6, for example.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. An explosive powder charge operated bolt-setting tool, comprising:

a bolt guide having a through bore;

an explosive powder charge actuable driving piston accommodated in said through bore;

a ball brake designed as a freewheel and comprising two axial stops, a recess defined between the axial stops, and two inserts, the recess opening radially toward the driving piston, the inserts with an oblique surface widening conically at an acute angle toward the piston;

two springs, one of said springs radially biased against each insert;

a retaining ring retaining the springs; and two brake balls loaded by the two springs, the brake balls disposed in the ball brake recess and bearing against the driving piston, the brake balls movable along the oblique surface between two axial stops.

2. A bolt-setting tool according to claim 1, wherein each spring comprises an elastomer block.

3. A bolt-setting tool according to claim 1, the ball brake further comprising a peripheral groove, the inserts comprising half shells disposed and radially movable in said peripheral groove.

4. A bolt-setting tool according to claim 1, the ball brake further comprising two semicircular extensions accommodated by the retaining ring, the recess disposed between said semicircular extensions.

5. A bolt-setting tool according to claim 1, wherein the ball brake, adjacent to its through opening for the driving piston, comprises axially extending shoulders for limiting the distance the brake balls are able to dip into the region of the through opening.

6. An explosive powder charge bolt setting tool comprising:

a housing;

a drive member;

a guide member extending from the housing, the guide having a through bore for receiving the drive member, the guide member through bore having an open end;

an explosive powder charge actuable driving piston with a piston head, the driving piston positioned in the housing to drive the drive member in the through bore; and a ball brake positioned at the open end of the through bore to brake the driving piston, the ball brake comprising a ball brake support structure, a pair of inserts and a pair of brake balls supported within the support structure, each insert axially spaced from the throughbore defining a pair of recesses, each insert radially moveable and biased radially inward, each insert having an inwardly facing brake ball engaging surface which widens conically at an acute angle away from the through bore, each brake ball positioned in a respective recess to bear against the driving piston and axially moveable therein between a pair or axially spaced stops, whereby when the driving piston is driven forward through the ball brake to drive a drive member, said brake balls brakingly engaging said driving piston, and said brake balls releasing from said engagement when the driving piston is retracted.

7. A bolt-setting tool according to claim 6, wherein the springs comprise elastomer blocks.

8. A bolt-setting tool according to claim 6, the ball brake defining a peripheral groove, the inserts being designed as half shells and movably and radially disposed in the peripheral groove.

9. A bolt-setting tool according to claim 6, the ball brake comprising a retaining ring and two semicircular extensions, wherein the recess is arranged between said two semicircular extensions, the semicircular extensions accommodated by the retaining ring.

10. A bolt-setting tool according to claim 6, the ball brake comprising a plurality of shoulders extending axially into the recess, the shoulders limiting the distance the brake balls are able to dip into the through opening.

* * * * *

UNITED STATES PATENT AND TRADEMARK OFFICE

CERTIFICATE OF CORRECTION

PATENT NO. : 6,092,710
DATED : July 25, 2000
INVENTOR(S) : Olaf Kersten

It is certified that error appears in the above-identified patent and that said Letters Patent is hereby corrected as shown below:

Column 1,
Line 57, after "consideration" insert -- of --.

Column 4,
Line 35, "throughbore" should be -- through bore --.

Signed and Sealed this

Twenty-sixth Day of March, 2002

*Attest:*

*Attesting Officer*

JAMES E. ROGAN
*Director of the United States Patent and Trademark Office*